United States Patent [19]

LaBate

[11] Patent Number: 4,526,351

[45] Date of Patent: Jul. 2, 1985

[54] SLAG AND HOT METAL RUNNER SYSTEM

[76] Inventor: Micheal D. LaBate, 115 Hazen Ave., Ellwood City, Pa. 16117

[21] Appl. No.: 595,724

[22] Filed: Apr. 2, 1984

Related U.S. Application Data

[63] Continuation-in-part of Ser. No. 447,408, Dec. 6, 1982.

[51] Int. Cl.[3] ..... F27D 3/14

[52] U.S. Cl. ..... 266/196; 266/236; 266/283

[58] Field of Search ..... 266/196, 236, 283

[56] References Cited

U.S. PATENT DOCUMENTS

| | | | |
|---|---|---|---|
| 2,409,741 | 10/1946 | Dobscha | 266/196 |
| 4,262,885 | 4/1981 | LaBate | 266/196 |
| 4,300,753 | 11/1981 | LaBate | 266/196 |
| 4,328,957 | 5/1982 | LaBate | 266/196 |
| 4,350,325 | 9/1982 | LaBate | 266/196 |
| 4,355,788 | 10/1982 | LaBate | 266/196 |

FOREIGN PATENT DOCUMENTS

| | | | |
|---|---|---|---|
| 50-47825 | 4/1975 | Japan | 266/196 |
| 54-29291 | 9/1979 | Japan | 266/196 |

*Primary Examiner*—Melvyn J. Andrews
*Attorney, Agent, or Firm*—Harpman & Harpman

[57] ABSTRACT

A runner system for receiving and conveying molten slag at the end of an iron pour includes a permanent trough-like construction in which a precast channel-shaped unitary liner is removably positioned so as to form a runner system capable of resisting the increased corrosive properties of slag and having a predetermined life.

15 Claims, 3 Drawing Figures

SLAG AND HOT METAL RUNNER SYSTEM

This is a continuation-in-part of Ser. No. 06/447,408, filed Dec. 6, 1982.

BACKGROUND OF THE INVENTION

1. Field of the Invention

This invention relates to an improvement in slag runner systems as used in the metal producing industry for delivering molten slag from a source to a remote point and providing the runners in the system with removable, replaceable, cross sectionally U-shaped liners.

2. Description of the Prior Art

Runners for handling hot metal are disclosed in U.S. Pat. No. 2,409,741 and such runners generally comprised metal shapes with clay liners as will be understood by those skilled in the art.

U.S. Pat. No. 3,365,187 discloses a typical runner system for a blast furnace. My prior U.S. Pat. Nos. 4,262,885, 4,300,753, 4,328,957, 4,350,325 and 4,355,788 disclose typical improvements in hot metal runners as utilized in the art.

SUMMARY OF THE INVENTION

The present invention relates to a runner system particularly adapted for conveying molten slag as from a blast furnace after an iron pour to a point of discharge. As such, the permanent or semi-permanent installation in the pouring floor includes an enlarged trough formed of concrete, refractory brick, and hydraulically bonded high alumina refractory concrete defining a trough approximately 40 inches wide and 40 inches deep in which a number of precast liner units having oppositely disposed sidewalls and an interconnecting bottom portion are removably placed, the side walls being approximately 10 inches thick and 30 inches high and the bottom of the precast unit being approximately 20 inches thick so that the resultant precast trough lining unit is particularly adapted to resist the corrosive properties of slag and thereby attain a substantially improved life as compared with slag runners heretofore known in the art.

The integral precast runner units being removable and/or replaceable quickly and easily in the enlarged permanent or semi-permanent trough in the pouring floor so as to contribute to the low cost maintenance of an effective long life slag runner system.

DESCRIPTION OF THE PREFERRED EMBODIMENT

Figure 1:
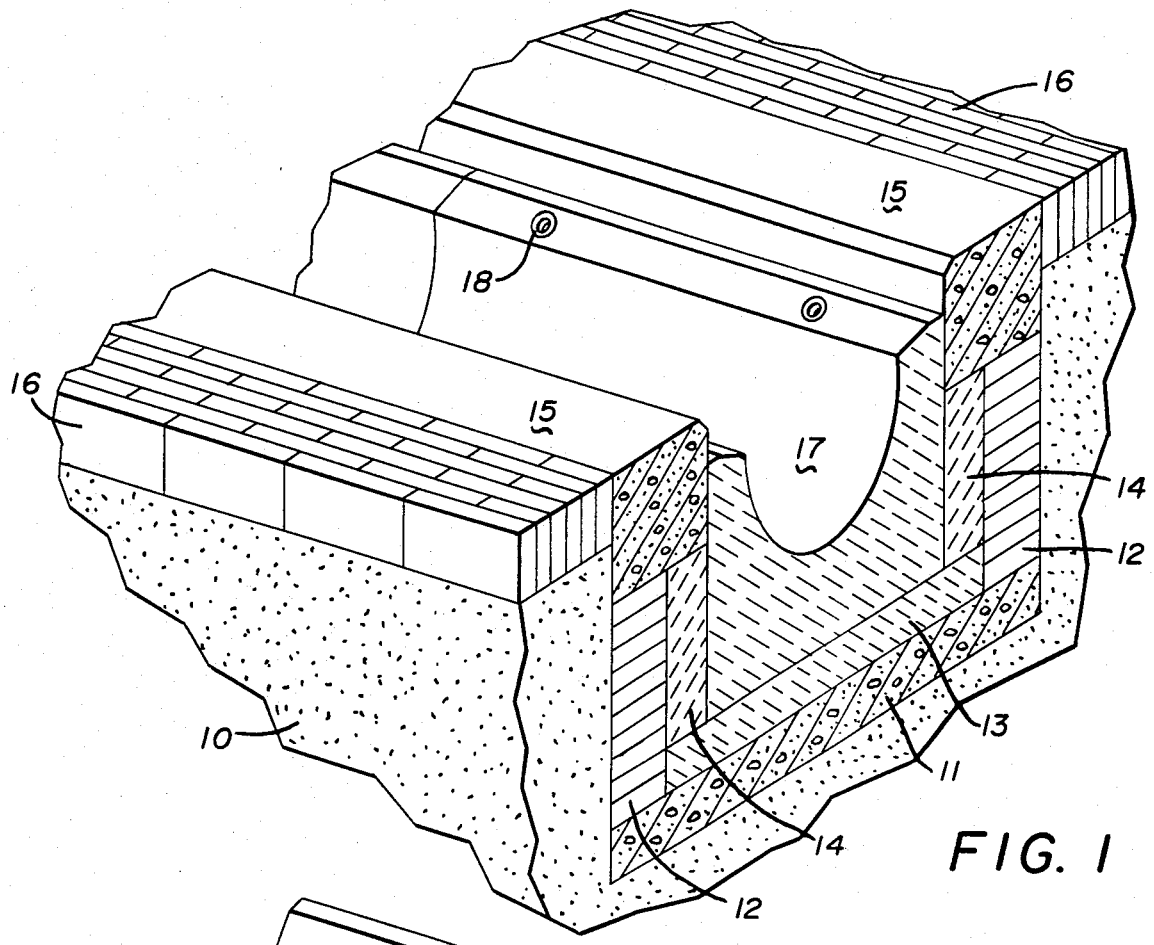
FIG. 1 is a perspective view of a portion of a slag runner system with parts broken away and parts in cross section.

By referring to the drawings and FIG. 1 in particular, it will be seen that a runner system for molten slag has been illustrated as being positioned in a pouring floor 10 such as adjacent a blast furnace. The runner system is positioned in a trench formed in the pouring floor 10 and comprises a concrete base slab 11 positioned on the bottom of the trench and a pair of spaced refractory brick side walls 12 defining portions of the sides of the trench.

A secondary slab 13 of hydraulically bonded high alumina refractory concrete is positioned on the concrete base slab 11 and extends between the refractory brick side walls 12. Precast blocks 14 formed of hydraulic bonded high alumina refractory concrete are positioned along the inner sides of the refractory brick walls 12. Concrete curbs 15 are positioned longitudinally on the upper surfaces of the refractory brick side walls 12 and the precast refractory concrete blocks 14, the several elements thus forming the permanent or semi-permanent portions of the slag runner system positioned in the pouring floor 10.

Additional refractory bricks 16 are preferably positioned along either side of the elongated concrete curbs 15 and form a working surface of the pouring floor 10 as will occur to those skilled in the art.

The slag runner system is completed by the installation of a plurality of monolithic cross sectionally U-shaped liner units 17 on the slab 13 with their sides in engagement with the precast blocks 14 and the concrete curbs 15. The lower portion of each liner unit 17 has its central upper surface transversely concave joining the vertical portions thereof which form side walls to complete the slag receiving and guiding runner system. The liner units 17 are preformed in desirable lengths and are provided at intervals along their upper edges with embedded ceramic inserts 18, each of which defines a threaded passageway for the reception of fasteners to facilitate the handling of the liner units 17 when they are removed and/or replaced as is occasionally necessary due to the erosion by the molten slag flowing through the runner system. The liner units 17 are advantageously formed of sinter alumina powder in a range from 20% to 60% by weight, silicon carbide powder in a range from 25% to 45% by weight, and fine clay or a comparable powdered refractory in a range of from 10% to 45% by weight together with a binder such as phosphoric acid or the like in a range from 10% to 20% by weight that chemically reacts with the powdered ingredients to form a dense heat resistant liner unit. The binder may include sodium silicate as an alternate to the phosphoric acid or the binder may comprise a 50—50 mixture of sodium silicate and phosphoric acid or the like.

The liner units 17 may be formed of the same materials except that water is added to the binder and the mixed dry powders on a 50—50 mixture basis so that the mixed powders become more pliable thus facilitating ramming of the pliable mixture into molds at the job site. The formed liner units are thus completed to form layers of different densities which are desirable in extending the life of the liner units.

Figure 2:
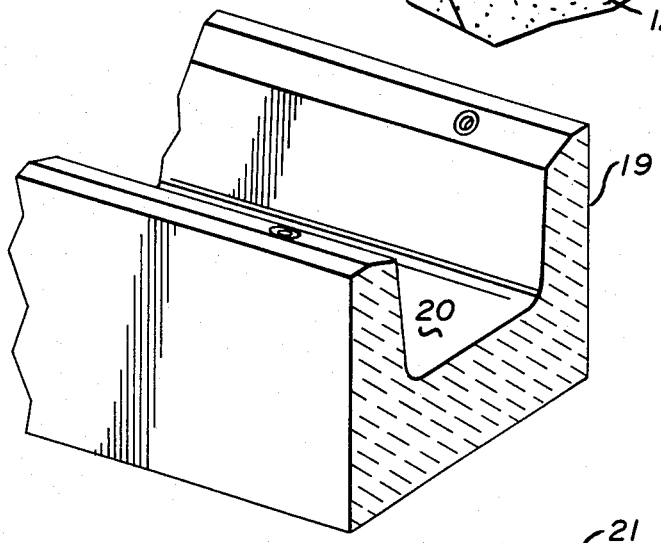
FIG. 2 is a perspective view of a portion of a modified precast liner unit for a slag runner with parts in cross section and parts broken away.

It will thus be seen that the liner units 17 as heretofore described comprise modular monolithic liner units as illustrated in FIG. 1 of the drawings and by referring to FIG. 2 of the drawings, a modified monolithic liner unit 19 will be seen with a different shaped bottom 20 replacing the curved bottom in the liner unit 17 of FIG. 1. The modified liner unit 19 is also prefabricated in the same manner as the liner unit 17 hereinbefore described and these removable, replaceable, modified liner units 19 with flat bottoms 20 thus comprise expendable portions of the slag runner systems disclosed herein.

Figure 3:
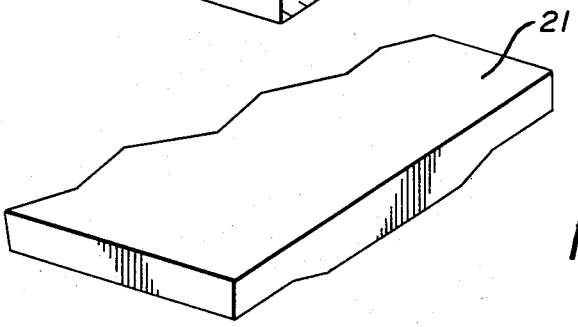
FIG. 3 is a perspective view of a portion of a cover unit which may be used with the slag runner system to close the same and limit air pollution.

If desired, covers 21 as seen in FIG. 3, formed of refractory material and preferably provided with transverse ribs over a portion of their lower surfaces can be installed continuously on the upper surfaces of the slag runner systems to both assist in controlling air pollution and maintaining temperatures at desired levels in the runner system.

A typical satisfactory mixture of refractory materials from which the liner units 17 and 19 can be successfully formed may comprise sinter alumina powder 20% by weight, silicon carbide powder 25% by weight, fine clay or a comparable refractory powder or particles 45% by weight and phosphoric acid 10% by weight and water 10% or less to achieve a desired consistency of the mixture so that the mixture resulting can be rammed in place in suitable molds in forming the liner units 17.

A further example of a suitable mixture from which the liner units 17 and 19 may be formed comprises sinter alumina between about 20% to 50% by weight, silicon carbide between about 20% by 40% by weight, fine clay between about 10% and 40% by weight, metallic aluminum between about 20% to 30% by weight and a binder between about 3% to 20% by weight from a group consisting of sodium silicate, phenolic resin, phosphoric acid and water to form a moldable mixture.

The material may also be rammed directly into the permanent or semi-permanent trough defining structure in the pouring floor to form a rammed in place liner unit.

Further examples of a suitable mixture from which the liner units 17 and 19 may be formed comprises: a coalesced mass of a mixture consisting of sinter alumina 15% by weight, silicon carbide 20% by weight, fine clay (also known as fire clay) 35% by weight, metallic aluminum 20% by weight, and sodium silicate 10% by weight; or a coalesced mass of a mixture consisting of sinter alumina 15% by weight, silicon carbide 25% by weight, fine clay 30% by weight, metallic aluminum 20% by weight and phenolic resin 10% by weight.

It will occur to those skilled in the art that the permanent or semi-permanent or trough defining structure is installed in the pouring floor and becomes a part thereof so that the liner units 17 and 19 as the case may be, can be formed on the job site on the pouring floor and installed in the trough defining structure and removed and replaced as necessary thus considerably improving efficiency on the hot metal pouring floor and avoiding the heretofore laborious and time consuming expensive rechanneling of hot metal and molten slag runners in the pouring floor and/or rearranging and aligning composite blast furnace runners and the like.

The liner units 17 and the rammed in place or prefabricated liner units 19 as disclosed herein can be coalesced under thermal influence or coalesced under the influence of physical force, or both, as desired. Vibratory motion as such physical force is satisfactory. The composition, density, size and shape of the liner units 17 and 18 can be varied as desired to achieve a predetermined life which can to a great extent eliminate the necessity of visually observing the amount of erosion after each running of molten slag through the runner system.

It will occur to those skilled in the art that various changes and modifications may be made in the invention disclosed herein without departing from the spirit of the invention.

Having thus described my invention what I claim is:

1. In a runner system for conveying molten slag across a pouring floor from a source of molten slag to a pouring point, the runner system including a trench means in the pouring floor for containing molten slag, the trench means including sides and a bottom, an improvement in combination therewith comprising:

a replaceable liner means located in the trench means for forming a replaceable channel in the trench means, said replaceable liner means including a plurality of monolithic units, each monolithic unit having a bottom portion and wall portions, said wall portions being in abutting relationship with the trench means sides and said bottom portion resting on the trench means bottom and extending completely across the trench means bottom between said liner means wall portions whereby the trench means reinforces said monolithic unit;

said monolithic units being unattached to each other or to the trench means to line the trench means with a plurality of unconnected and unattached monolithic units whereby any one of said plurality of monolithic units can be removed from the trench means without significantly disturbing either the trench means or any other monolithic unit.

2. The improvement defined in claim 1 wherein said monolithic units are formed of a plurality of materials including sinter alumina, silica carbide, fire clay, phosphoric acid and a binder that chemically reacts with the other materials.

3. The improvement defined in claim 1 wherein said monolithic unit wall portions extend from the trench means bottom upwardly for a significant portion of the distance between the trench means bottom and the top surface of the pouring floor.

4. The improvement defined in claim 2 wherein said binder includes sodium silicate.

5. The improvement set forth in claim 1 and wherein said monolithic units are formed of a coalesced mass of sinter alumina between about 20% to 60% by weight, silicon carbide between about 25% to 45% by weight, fine clay between about 10% to 45% by weight and a binder between about 10% to 20% by weight from a group consisting of sodium silicate and phosphoric acid and water to form a moldable mixture.

6. The improvement set forth in claim 1 and wherein said monolithic units are formed of a heat coalesced mass of a mixture consisting of sinter alumina 20% by weight, silicon carbide 25% by weight, fine clay 45% by weight and phosphoric acid 10% by weight and water to mix a desired consistency suitable for shaping.

7. The improvement set forth in claim 1 and wherein said monolithic units are formed of a vibratory force coalesced mass of a mixture consisting of sinter alumina 20% by weight, silicon carbide 25% by weight, fine clay 45% by weight and phosphoric acid 10% by weight and water to mix a desired consistency suitable for shaping.

8. The improvement set forth in claim 1 wherein said monolithic units are formed of a coalesced mass of a mixture consisting of sinter alumina between 20% to 50% by weight, silicon carbide between about 20% to 40% by weight, fine clay between about 10% and 40% by weight, metallic aluminum between about 20% and 30% by weight, and a binder between about 3% and 20% by weight from a group consisting of sodium silicate, phenolic resin, phosphoric acid and water to form a moldable mixture.

9. The improvement set forth in claim 1 and wherein said monolithic units are formed of a coalesced mass of a mixture consisting of sinter alumina 15% by weight, silicon carbide 20% by weight, fine clay 35% by weight, metallic aluminum 20% by weight and sodium silicate 10% by weight.

10. The improvement set forth in claim 1 wherein said monolithic units are formed of a coalesced mass of a mixture consisting of sinter alumina 15% by weight, silicon carbide 25% by weight, fine clay 30% by weight, metallic aluminum 20% by weight and phenolic resin 10% by weight.

11. In a runner system for a hot metal pouring floor, said runner system extending from a source of molten metal and molten slag to a pouring point thereof, said runner system comprising a substantially permanent elongated trough defining structure having fixed side and bottom portions positioned in said pouring floor, an improvement in combination therewith comprising: a replaceable means for lining the runner system, said means for lining said runner system consisting of a plurality of channel shaped and monolithic units each including side walls extending from the trough bottom portion upwardly for a significant portion of the distance between the trough bottom portion and a top surface of the pouring floor and a bottom section positioned on the trough defining structure bottom portion, each monolithic unit being unattached to any other unit or to the trench defining structure so that each unit can be removed from the trench defining structure without significantly disturbing any other unit or the trench defining structure, said monolithic units being formed of sinter alumina in a range from 20% to 60%, silicon carbide in a range from 25% to 45%, fine clay in a range from 10% to 35%, a binder selected from a group consisting of sodium silicate and phosphoric acid that reacts with the other materials, and water substantially 10% by weight, said side walls being positioned in said trough defining structure against the sides thereof to oppositely disposed relation to one another and said bottom section being positioned in said trough defining structure on the bottom portion thereof whereby said monolithic units reinforce said elongated trough defining structure and said plurality of monolithic units form a replaceable channel for said molten metal and molten slag.

12. The improvement defined in claim 11 wherein each of said monolithic units is in abutting relationship which an adjacent monolithic unit.

13. The improvement set forth in claim 11 wherein said elongated trough defining structure has base slabs of hydraulically bonded high alumina content refractory and prefabricated side walls of hydraulically bonded high alumina concrete on and against which said preformed liner units are positioned, said liner units supported on said base slab.

14. The improvement set forth in claim 11 wherein said trough defining structure has a concrete base slab, transversely spaced side wall portions formed of refractory bricks positioned thereon, a secondary slab formed of hydraulically bonded high alumina concrete on said base slab, secondary side walls formed of hydraulically bonded high alumina concrete on said secondary slab in oppositely disposed relation and against said refractory brick side walls, longitudinally extending concrete curbs on said side walls defining with said secondary slab said elongated trough structure and said liner units are positioned in said elongated trough structure against said secondary sidewalls thereof on said secondary slab.

15. The improvement set forth in claim 14 and wherein the overall height of said side wall portions of hydraulically bonded high alumina concrete and said concrete curbs is greater than the height of said monolithic liner units.

* * * * *